US006817911B2

(12) United States Patent
Elizondo

(10) Patent No.: US 6,817,911 B2
(45) Date of Patent: Nov. 16, 2004

(54) HYDRO-MAX MOTORBOAT PROPELLER ANTI-SLIPPAGE SHROUD

(75) Inventor: Luis Daniel Elizondo, Grovetown, GA (US)

(73) Assignee: Luis Elizondo, Stevensville, MD (US)

( * ) Notice: Subject to any disclaimer, the term of this patent is extended or adjusted under 35 U.S.C. 154(b) by 0 days.

(21) Appl. No.: 10/213,778

(22) Filed: Aug. 8, 2002

(65) Prior Publication Data

US 2004/0147181 A1 Jul. 29, 2004

Related U.S. Application Data

(63) Continuation-in-part of application No. 09/777,518, filed on Feb. 6, 2001, now abandoned.

(51) Int. Cl.[7] ..... B63H 1/16
(52) U.S. Cl. ..... 440/67; 440/71
(58) Field of Search ..... 440/49, 66, 67, 440/71; 114/274

(56) References Cited

U.S. PATENT DOCUMENTS

| | | | | | |
|---|---|---|---|---|---|
| 5,213,525 | A | * | 5/1993 | Sanford | 440/49 |
| 5,352,140 | A | * | 10/1994 | Schriner | 440/67 |
| 5,389,021 | A | * | 2/1995 | Padgett | 440/67 |
| 5,597,245 | A | * | 1/1997 | Meyerhoff | 440/67 |
| 5,848,922 | A | * | 12/1998 | Itima et al. | 440/66 |
| 6,059,618 | A | * | 5/2000 | Purnell et al. | 440/38 |

* cited by examiner

*Primary Examiner*—Stephen Avila

(57) ABSTRACT

A propulsion system component or accessory specifically used for boats which utilize either an inboard-outboard motor, or an outboard motor. A cylindrical shroud very closely surrounds the peripheral sides of a propeller situated inside, while leaving exposed the front and rear surface areas of the propeller. The shroud closely surrounds the peripheral circumference of the propeller blades by 360 degrees. This unique aspect of the shroud minimizes slippage and maximizes fluid displacement. The shroud is installed symmetrically as to ensure uniform distance between the shroud and all propeller blades. The front of the shroud is considered the leading edge, and the rear of the shroud is considered the trailing edge. The leading edge of the shroud allows unrestricted laminar flow to the propeller from the front. The trailing edge of the shroud directs propeller wash from the rear of the propeller, out through the trailing edge of the shroud. The trailing edge of the shroud is unique in that it extends behind a propeller's trailing edge by at least 12 inches, enough to restrict accidental access of the average adult size foot even if placed directly inside the shroud. The shroud is provided with apparatus for mounting on the lower portion of the motor itself, or could be factory casted directly by the motor boat engine manufacturer. Installation of the system requires little modification to the motor itself. This system requires no modification to the boat, transom, or propeller. The system will minimize slippage, while maximizing fluid displacement, expulsion zone exit flow rates, and individual safety.

3 Claims, 6 Drawing Sheets

HYDRO-MAX MOTORBOAT PROPELLER ANTI-SLIPPAGE SHROUD

This application is a Continuation in Part of U.S. patent application Ser. No. 09/777,518 filed Feb. 6, 2001, and now abandoned

BACKGROUND OF THE INVENTION

1. This invention relates to a motorboat propeller anti-slippage shroud.

2. Description of the Prior Art

Past and current designs of high revolution marine inboard-outboard motors, outboard motors, and respective propellers, suffer from inefficient fluid displacement ratios, resulting in an overall loss in performance and efficiency. Ideally, a ratio closest to a one-to-one is desirable, resulting in every unit of fluid being displaced by the leading edge of the propeller, is displaced at the trailing edge of the propeller. Current designs of propellers do not achieve nearly the ideal ratio due to the phenomena of "slippage". The phenomena of slippage occurs at all speeds in which hydro-mechanical flow passing through the front of a propeller (intended to be displaced at the rear of the propeller), is in-fact, lost prematurely on the peripheral sides of the blades. Peripheral exposure of a propeller's blades, and lack of enclosure of the blades results in this phenomena. As a result, overall pressure and fluid velocity is decreased at the outflow point of a propeller. The net result is less distance obtained by the boat per each revolution of a propeller and less fuel efficiency. In addition, prior designs of motorboat propellers experience atmospheric ventilation at high speed because atmospheric gases are introduced to the peripheral edges of a propeller blade. Introduction of gaseous ventilation also decrease the overall mass and velocity of the fluid being displaced by a propeller, and again decreasing performance and efficiency, especially at high rates of revolution. Another disadvantage of the prior art is that inadvertent or accidental contact with the propeller may occur during times of revolution, resulting in personal injury. This is again due to the fact that the trailing edge and peripheral portions of a propeller's blades are exposed. Finally, should a propeller with exposed blades make contact with a submerged hard surface, catastrophic failure of a propeller can occur.

SUMMARY OF THE INVENTION

1. A motorboat propeller anti-slippage shroud used for high revolution inboard-outboard and outboard motors comprising:

(1) A motor boat propeller anti-slippage shroud for use on power boats other than sailboats (2) A cylindrical shroud which is fixed to the lower portion of either a high revolution per-minute inboard-outboard motor, or outboard motor, for use by a speed boat, ski boat, or motor yacht (not intended for use by a sailboat)

(3) the shroud eliminating accidental access to the rear and peripheral portion of a propeller enclosed by the shroud during periods of high revolution by either individuals, or accidental encounters with submerged objects, or grounding (4) the shroud minimizing slippage while maximizing fluid displacement input-output ratios per each revolution of a propeller, maximizing fuel economy and performance at all speeds (5) the shroud commencing just forward of an enclosed propeller, but behind a ruder fixture, and extending rearward and behind an enclosed propeller's trailing edge by at least 12 inches to avoid accidental contact with a propeller even if a person's foot were placed directly inside the shroud (6) the leading edge of the shroud allowing unrestricted hydro-mechanical flow to a propeller blade's leading edge, while the peripheral side of the shroud closely encompassing the entire peripheral circumference of a propeller, eliminating fluid displacement and subsequent loss of fluid from the peripheral side of each propeller blade, minimizing slippage during rates of high revolution (7) the circumference of the shroud only slightly larger in diameter than a propeller located inside the shroud, with little distance between the shroud's inner circumference and the outer circumference of a propeller.

(8) the leading edge of the shroud is situated behind an integrated rudder as not to impede or compromise steering (9) the shroud centered to ensure uniform distance between the surface of the inner circumference of the shroud and the outer circumference of a propeller's blades to ensure minimal slippage and maximum hydro-dynamic displacement

(10) the shroud being constructed of either cast iron, or other metallic substance, or a durable, hardened plastic composite not subject to warping or deformation

(11) means for mounting the shroud is either bolt-on method for a retro-fit model, or casted from factory during time of motor production from assembly line, directly to the lower (submerged) portion of a high revolution rate inboard-outboard motor or outboard motor

(12) the shroud not restricting adequate passage of hydro-mechanical flow to a motor's cooling system

BRIEF DESCRIPTION OF THE DRAWINGS

In drawings which illustrate the embodiments of the invention.

DETAILED DESCRIPTION OF THE INVENTION

Figure 1:
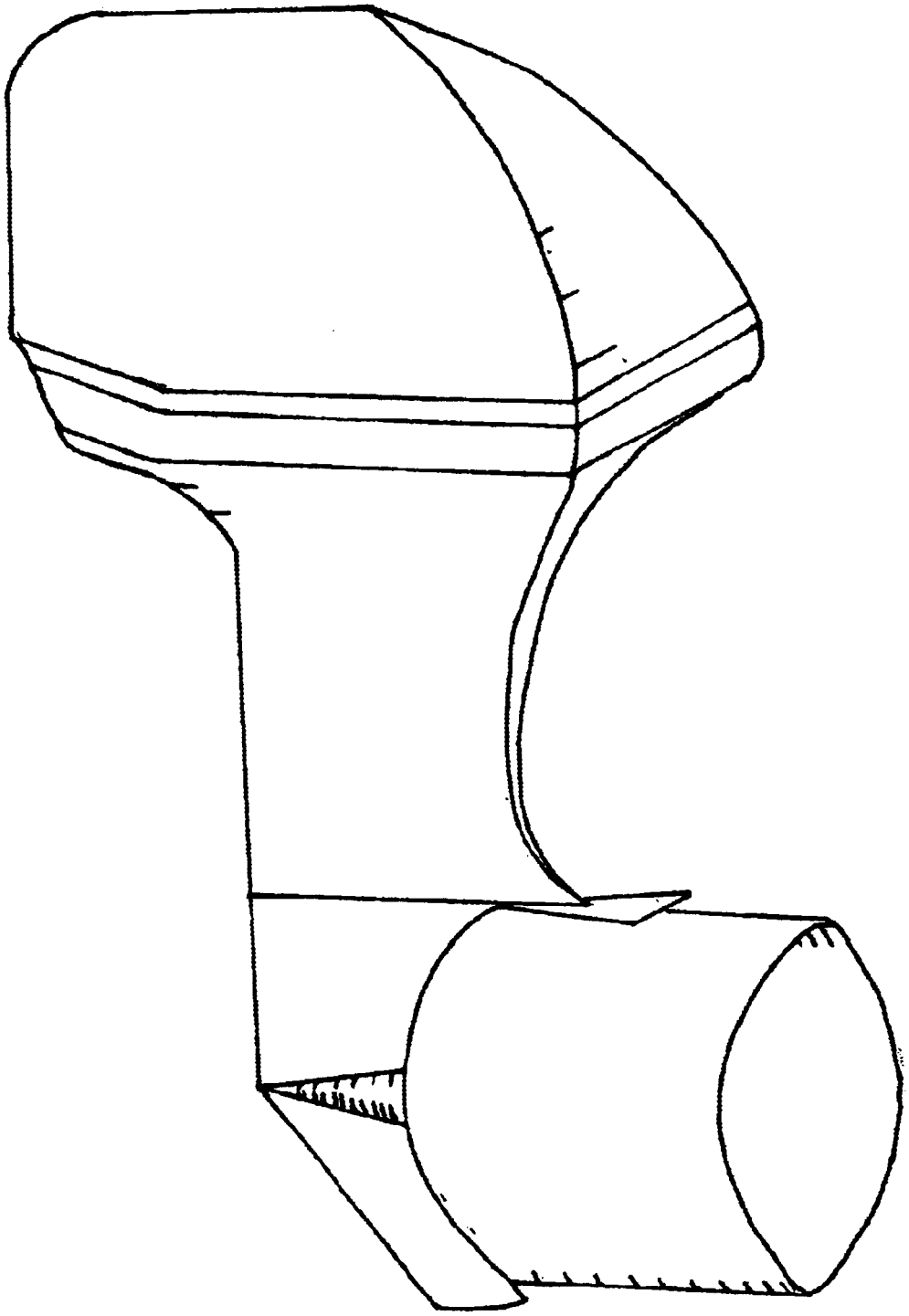
FIG. 1 illustrates a partial side view of the proposed shroud, fixed to a high revolution outboard motor boat engine showing relative scale and placement, and the shroud's relationship to an integrated rudder.

Referring to FIG. 1 in greater detail, there is shown the proposed cylindrical shroud which is mounted directly to the lower (submerged) portion of a high revolution motor, and closely encompasses the peripheral sides of a propeller by 360 degrees. The shroud is situated behind an integrated rudder, allowing full performance of its intended design and function. The shroud is cylindrical in shape, with both leading and trailing edges open without restriction, to allow the unrestricted hydro-dynamic flow both to, and away from a propeller. The leading edge of the shroud is placed significantly closer to the front of a propeller than the trailing edge. The trailing edge of the shroud extends rearward and behind a propeller's trailing edge at least 12 inches which is the average size of an adult foot. The inner diameter of the shroud is only slightly larger than the outer diameter of a propeller located inside it. The small distance between the inner circumference of the shroud and the outer circumference of a propeller minimizes slippage by eliminating slippage and directing fluid from a propeller's leading edge to a propeller's trailing edge, while maximizing fluid input-output ratios. The bottom portion of the shroud does not protrude lower than the lowest point of an integrated rudder, reducing the risk of grounding. The upper portion of the shroud is situated below the water line, and because it is a solid surface, the risk of atmospheric ventilation is reduced significantly. The shroud does not interfere with proper functioning of an outboard motor's cooling system. Inadvertent or accidental access to the leading edge, trailing edge, and peripheral portions of a propeller's blades is denied, therefore reducing the risk of personal injury or incident during times or propeller revolution. The trailing edge of the shroud extends rearward at least 12 inches from a propeller, alleviating accidental contact with the propeller even if a foot were placed directly inside the shroud. This unique aspect of the shroud is what maximizes personal safety. The shroud can be retrofitted by the utilization of galvanized fasteners, or can be pre-casted from an outboard engine manufacturer during assembly line fabrication.

Figure 2:
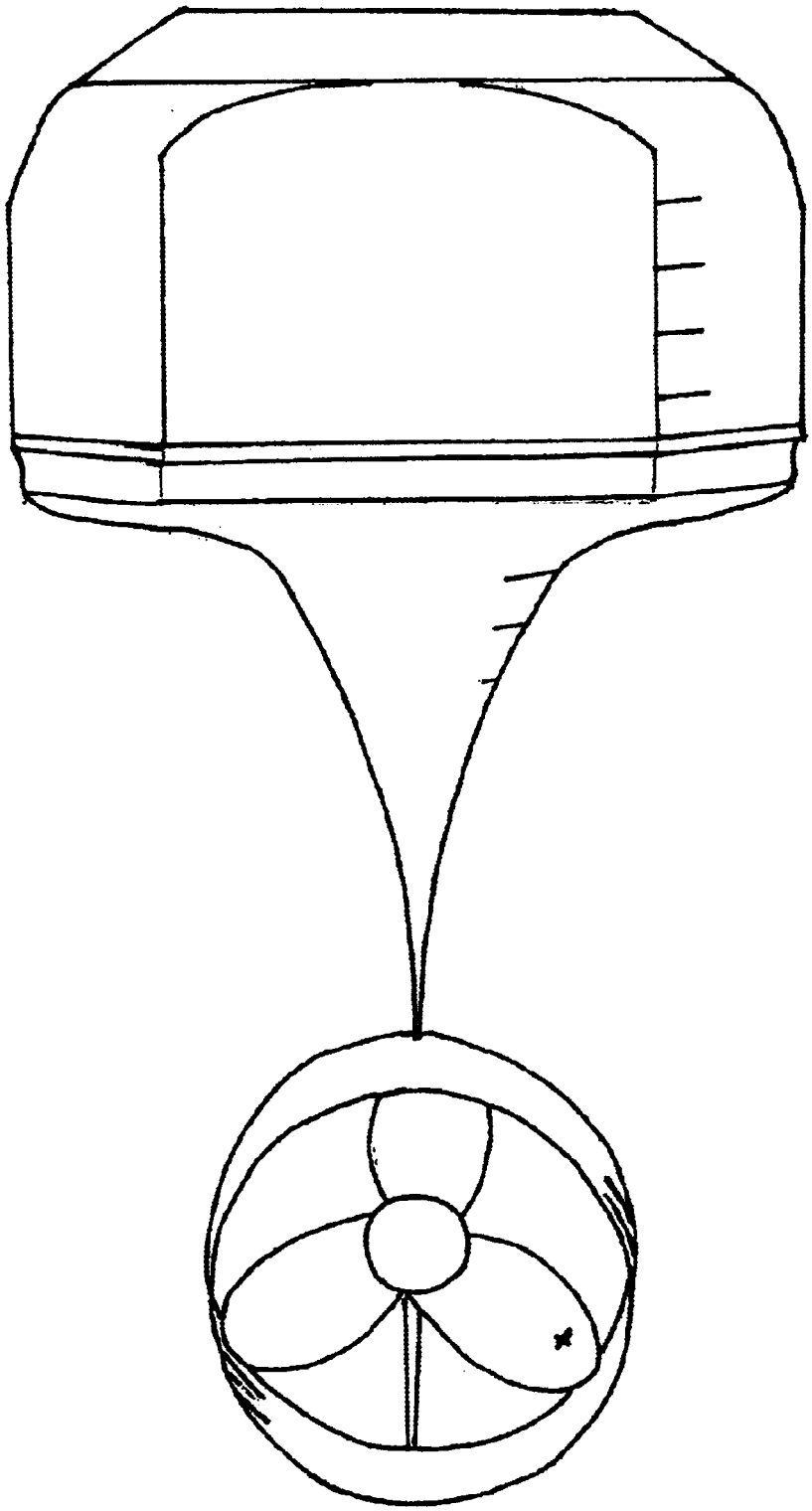
FIG. 2 illustrates a partial rear view of the proposed shroud, fixed to a high revolution outboard motor boat engine, showing relative scale and placement, and the shroud's relationship to the leading edge of a propeller.

Referring to FIG. 2 in greater detail, there is shown the proposed shroud which is mounted directly to the lower (submerged) portion of a high revolution motor, and allows unrestricted outflow from a propeller and away from the shroud's trailing edge. The diameter of the leading edge of the shroud is large enough to allow a propeller to displace a significant enough amount of fluid and avoid choking. The shroud is cylindrical and therefore the diameter of the shroud is uniform and symmetrical in relationship to a propeller. The diameter of the shroud is only slightly larger than a propeller, resulting in its anti-slippage characteristics. This unique aspect of the shroud results in the increase of performance. The trailing edge of the shroud directs maximum outward flow of propeller wash rearward, and focusing thrust at high rates of propeller revolution. Fluid which was restricted from being lost at the peripheral portions of a propeller as a result of the shroud (See FIG. 1.), is displaced along with the rest of the fluid, away from the trailing edge of the shroud. Exhaust from the high revolution outboard motor is not interfered with by the shroud. Replacement and servicing of a propeller is conducted in the same manner routine maintenance is performed on high revolution outboard motors without the shroud. Access to a propeller is gained from the trailing edge of the shroud. Future applications of the shroud may incorporate a slightly tapered trailing edge for various increased performance applications.

Figure 3:
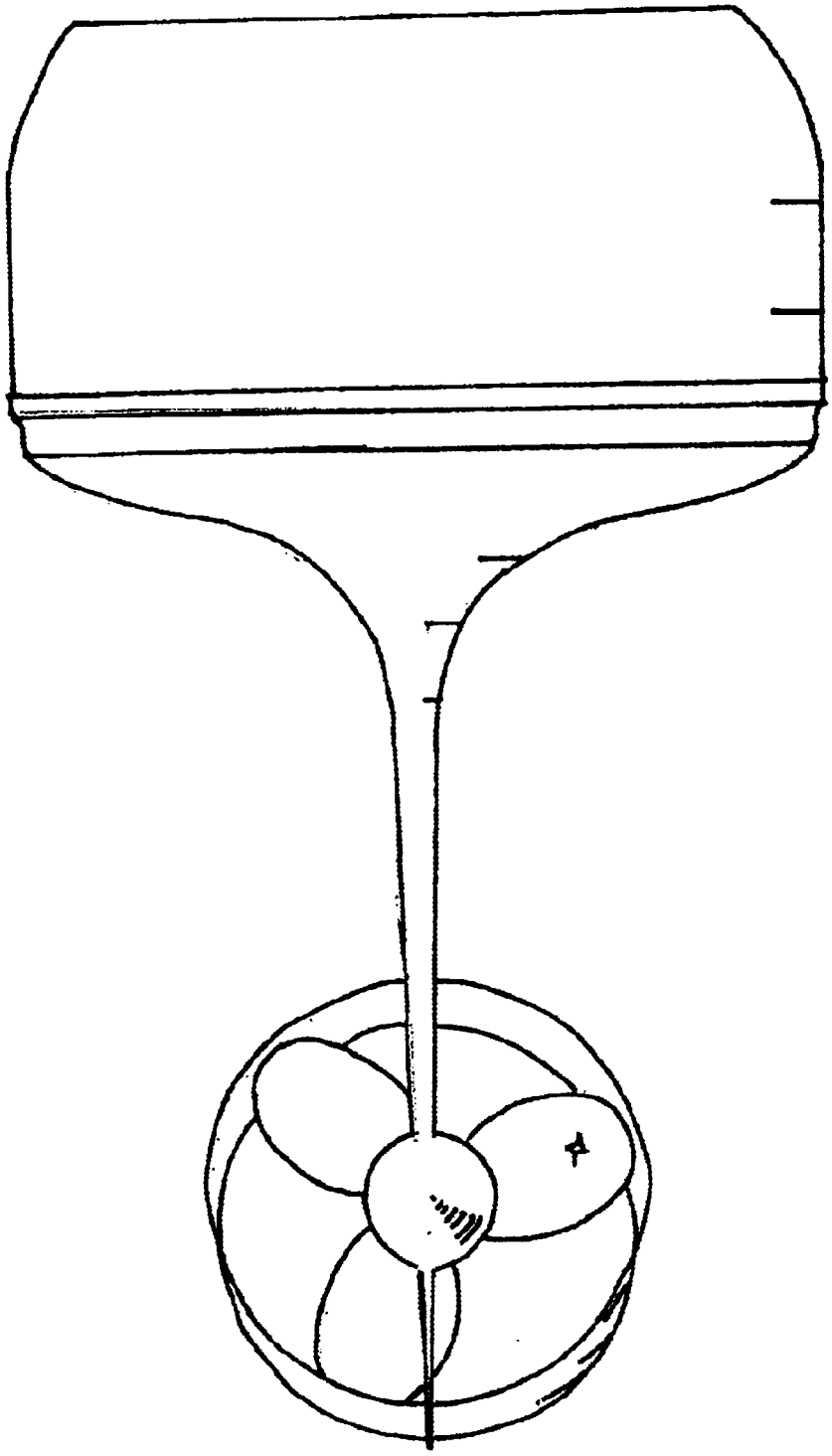
FIG. 3 illustrates a partial front view of the proposed shroud, fixed to a high revolution outboard motor boat engine, showing relative scale and placement, and the shroud's relationship to the trailing edge of a propeller.

Referring to FIG. 3 in greater detail, there is shown the proposed shroud which is mounted directly to the lower portion of a high revolution outboard motor, and allows unrestricted access of fluid to the front of a propeller from the shroud's leading edge. Fluid is still allowed to pass by an outboard motor stock integrated rudder before entering the shroud. The diameter of the leading edge of the shroud is large enough to allow the appropriate volume of fluid to make contact with the leading edge of a propeller and be displaced to the rear. The shroud is cylindrical and therefore the diameter of the shroud is uniform, symmetrical, and only slightly larger in relationship to a propeller.

Figure 4:
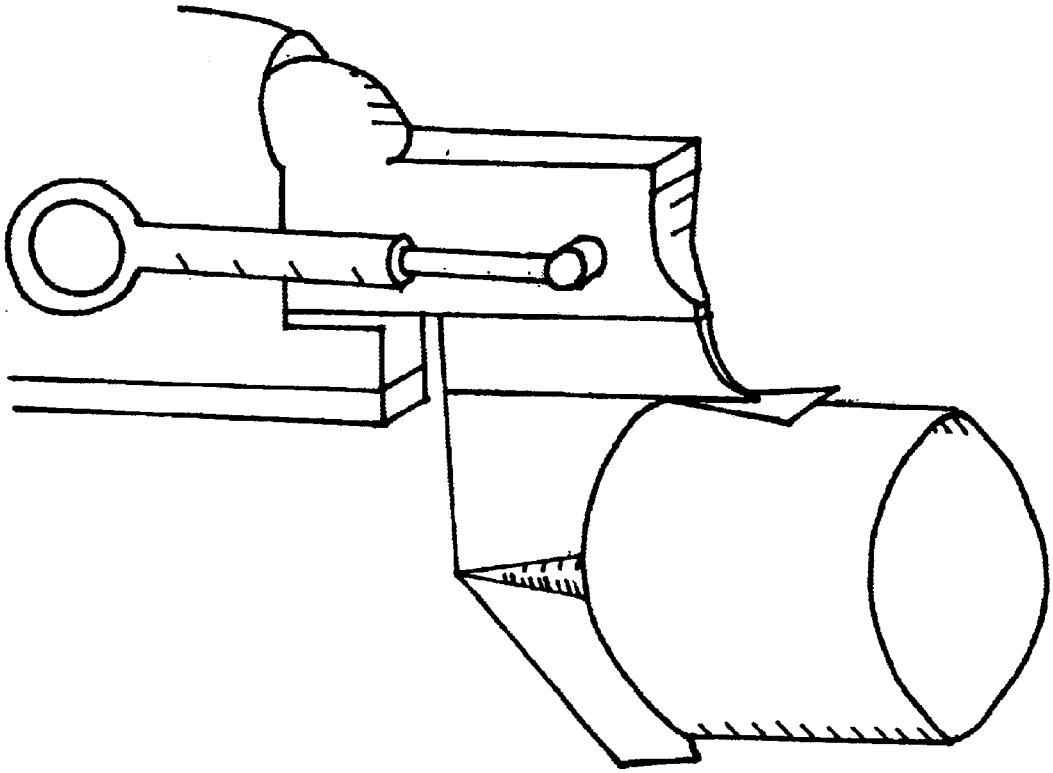
FIG. 4 illustrates a partial side view of the proposed shroud, fixed to a high revolution inboard-outboard motor boat engine showing relative scale and placement, and the shroud's relationship to an integrated rudder.

Referring to FIG. 4 in greater detail, there is shown the proposed shroud which is mounted directly to the lower portion of a high revolution inboard-outboard motor, and encloses the peripheral sides of the propeller by 360 degrees. All aspects are the same with respect to FIG. 1

Figure 5:
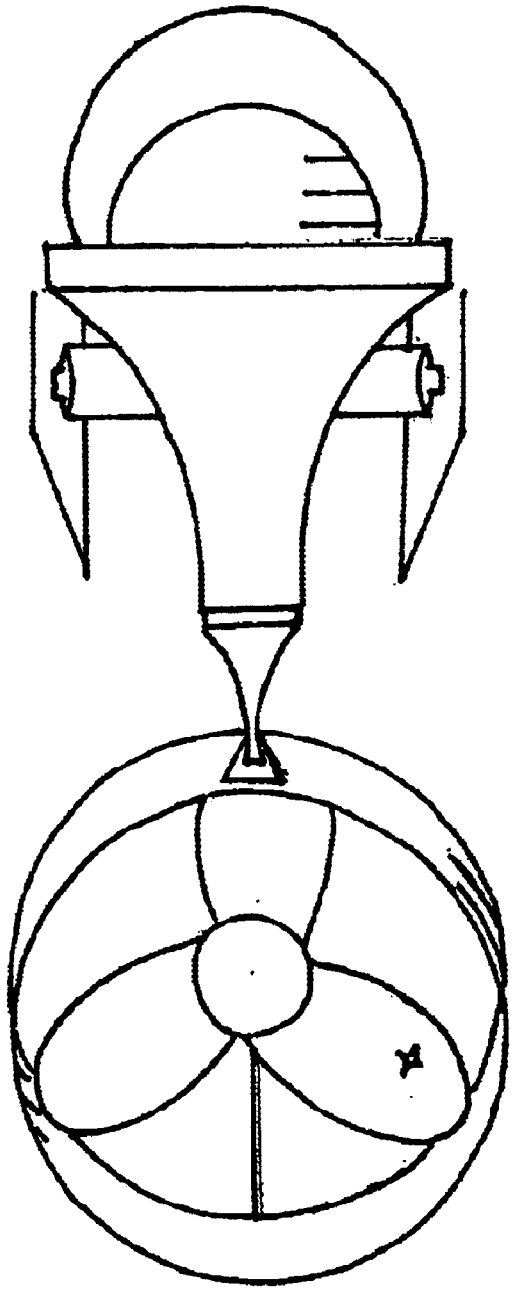
FIG. 5 illustrates a partial rear view of the proposed shroud, fixed to a high revolution inboard-outboard motor boat engine, showing relative scale and placement, and the shroud's relationship to the leading edge of a propeller.

Referring to FIG. 5 in greater detail, there is shown the proposed shroud which is mounted directly to the lower portion of a high revolution inboard-outboard motor, and encloses the peripheral sides of the propeller by 360 degrees. All aspects are the same with respect to FIG. 2.

Figure 6:
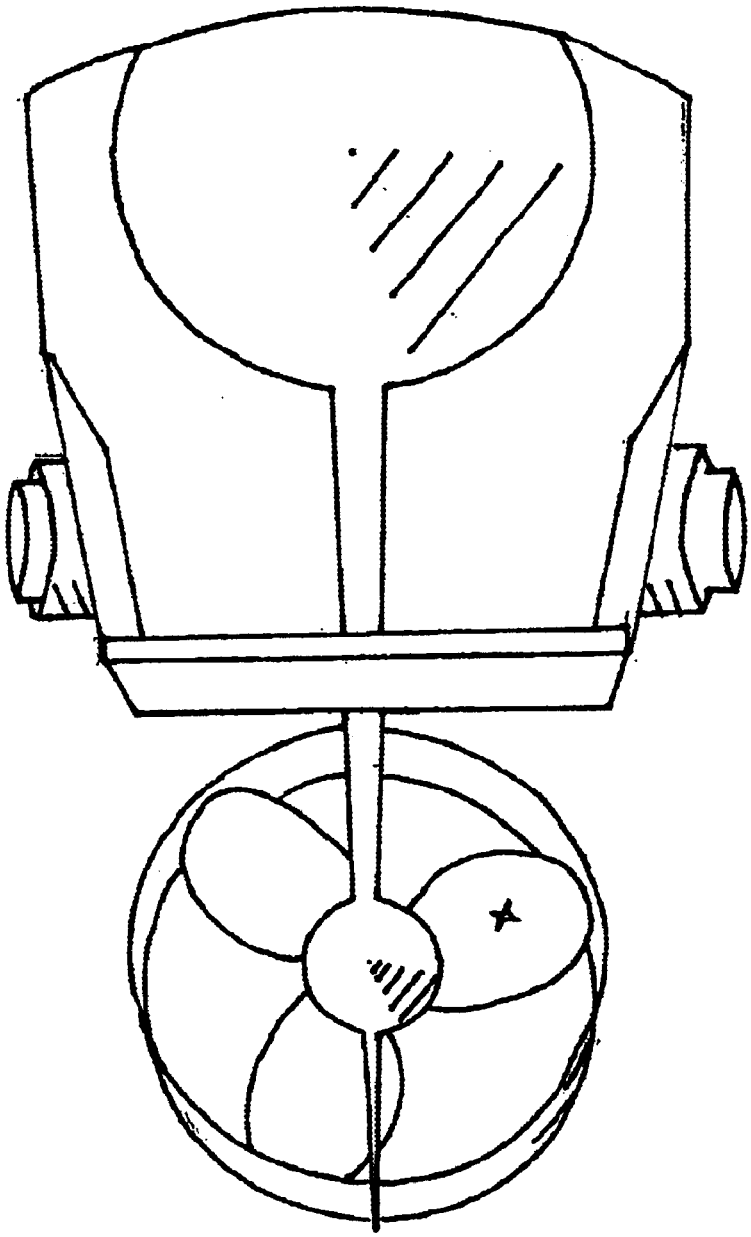
FIG. 6 illustrates a partial front view of the proposed shroud, fixed to a high revolution inboard-outboard motor boat engine, showing relative scale and placement, and the shroud's relationship to the trailing edge of a propeller.

Referring to FIG. 6 in greater detail, there is shown the proposed shroud which is mounted directly to the lower portion of a high revolution inboard-outboard motor, and encloses the peripheral sides of the propeller by 360 degrees. All aspects are the same with respect to FIG. 3.

During experimentation, it was observed that the efficiency of a propeller is greatly increased when slippage is decreased. By virtue of design of either a rotating turbine or impeller, closely enclosing the circumference of rotating blades on all peripheral sides maximizes input/output ratios closer to one-to-one, and thus maximizing flow rates and performance. Generally, the more the fluid output rate is mathematically similar to the fluid input rate, the more fluid is displaced. This becomes more apparent at greater rates of revolution. With the present invention, virtually all the fluid which enters the shroud on its leading edge is displaced by a propeller, and is forced out the trailing edge. This application is not suitable for motors with very low rates of revolution or minimal fluid displacement characteristics, nor is it designed for use by sailboats. The said invention is intended to be specifically used by motor boats with planing hulls. In addition, the trailing edge of the said invention is unique in that it extends behind a propeller's trailing edge by at least 12 inches, enough to restrict accidental access of an individual's foot even if placed directly inside the shroud. Individuals benefiting from this safety design of the said invention include children and adults engaged in water sports to include, but not limited to water skiing, snorkeling, and scuba diving. Motor boats benefiting from the performance design of the said invention include ski boats, racing boats, fishing boats, and motor yachts. Finally, the said invention can be applied to any recreational motor boat with either a high revolution outboard motor, or inboard-outboard motor whose propeller blades are peripherally exposed to the surrounding environment, individuals, endangered aquatic mammals, or other submerged objects.

I claim:

1. A motor boat propeller anti-slippage shroud for use on power boats other than sailboats, comprising of a cylindrical shroud which is fixed to the lower submerged portion of either a high revolution per-minute inboard-outboard motor, or outboard motor, for use by a speed boat, ski boat, recreational boat, or motor yacht, not intended for use by a sailboat, the shroud commencing just forward of a propeller, but behind a rudder fixture as not to impede or compromise steering, and extending directly rearward and behind a propeller's trailing edge by at least 12 inches, increasing safety; the shroud having only a slightly larger inner diameter than the said propeller's outer diameter, centered inside the shroud's inner circumference resulting in uniform distance between the inner surface of the shroud and the peripheral sides of a propeller's blades; the leading edge of the shroud allowing unrestricted hydro-mechanical flow to a propeller blade's leading edge, while the circumference of the shroud closely encompasses the entire peripheral circumference of a propeller, eliminating displacement and loss of fluid from the peripheral side of each propeller blade, minimizing slippage during rates of high revolution and increasing performance.

2. The propeller shroud of claim 1 minimizing slippage by closely encompassing the peripheral circumference of a propeller and minimizing the distance between the inside circumference of the said shroud and the peripheral circumference of a propeller situated inside; maximizing fluid displacement input-output ratios per each revolution of the propeller while avoiding peripheral loss of fluid, resulting in maximized performance of a propeller during all operating speeds, an increase in fuel economy, and eliminating accidental trailing edge and peripheral access to the propeller blades during periods of revolution by individuals.

3. The propeller shroud of claim 1 commencing just forward of a propeller, but behind a rudder fixture, and extending rearward and behind a propeller's trailing edge by at least 12 inches to avoid accidental contact with a propeller even if a person's foot were placed directly inside the shroud; being constructed of either cast iron, or other metallic substance, or a durable, hardened plastic composite not subject to warping or deformation; mounted to the lower submerged portion of a high revolution rate inboard-outboard motor motor or outboard motor by means of either bolt-on method for a retro-fit model, or casted from factory during time of motor production from assembly line.

* * * * *